US005915812A

United States Patent [19]

Terban

[11] Patent Number: 5,915,812

[45] Date of Patent: Jun. 29, 1999

[54] ROCKER BLOTTER

[76] Inventor: Paul L. Terban, 1386 Old Quincy La., Reston, Va. 22094

[21] Appl. No.: 09/010,555

[22] Filed: Jan. 22, 1998

Related U.S. Application Data

[60] Provisional application No. 60/049,504, Jun. 16, 1997.

[51] Int. Cl.[6] ..... B43L 17/08

[52] U.S. Cl. ..... 34/95.3; 34/95.4

[58] Field of Search ..... 34/95, 95.1, 95.2, 34/95.3, 95.4; 269/92, 93, 94; D19/98

[56] References Cited

U.S. PATENT DOCUMENTS

| | | | |
|---|---|---|---|
| D. 336,493 | 6/1993 | Brüssing | D19/98 |
| 522,432 | 7/1894 | Rudge et al. | 269/94 |
| 582,164 | 5/1897 | Bacon | 269/93 |
| 584,040 | 6/1897 | Keeler | 269/93 |
| 708,525 | 9/1902 | Buskirk | 269/32 |
| 736,289 | 8/1903 | Murray | 269/94 |
| 835,323 | 11/1906 | Raupach | 269/93 |
| 1,009,785 | 11/1911 | Peterson | 269/93 |
| 1,182,919 | 5/1916 | Magosy | 269/94 |
| 1,320,596 | 11/1919 | Aoki | 34/95.4 |
| 1,405,558 | 7/1922 | Schwartz | 269/93 |
| 1,460,507 | 7/1923 | Schwartz | 269/93 |
| 1,785,229 | 12/1930 | Schuelke | 269/32 |
| 1,847,047 | 2/1932 | Guerra | 34/95.4 |
| 2,272,955 | 2/1942 | Spitalnik | 269/94 |
| 3,161,177 | 12/1964 | Gach | 269/93 |

*Primary Examiner*—Henry Bennett
*Assistant Examiner*—Steve Gravini
*Attorney, Agent, or Firm*—Thomas Zack

[57] ABSTRACT

A universal blotter mount apparatus having a flexible blotter backing whose two side edges are received by inwardly and upwardly facing slanted retaining lips located on the surface of a mounting plate. The mounting plate is inserted into a recessed portion of another blotter top or many be formed integral therewith. The edges of the blotter paper and its flexible flush mounted backing are retained together only by their inherent flexible bent condition and the mount's lips. To remove or replace them, the backing and any inserted blotting paper is simply bent to a more severe angle and lifted from the retaining opposite side mounting lips.

8 Claims, 2 Drawing Sheets

ROCKER BLOTTER

This application claims the benefit of the U.S. provisional application 60/049,504 filed Jun. 16, 1997.

BACKGROUND OF THE INVENTION

Blotters of many types and configurations have been known for well over a hundred years. with many blotters there is mounting backing surface for the blotter paper or an intermediate blotter paper backing on which the paper bears against interposed between the mounting backing and the blotter paper. The backing surface may be rocker-shaped and may be held along with blotter paper to the mounting backing surface in a variety of ways. Included in the ways these components are held to the mount backing surface are the use of ends that are curved, have holding flanges, springs, straps, glue, triangular corner pockets, clamping plates, etc. Each such holding methods or apparatus for the blotter paper or its backing, or both, has its merits and disadvantages. The present invention seeks to improve on the previously used methods and apparatuses used to hold the blotting paper and its backing to a mount by providing for two opposed slanted facing end lips into which the ends of a flexible backing for the blocking paper fit while the paper's backing is seated within a recessed surface of the blotter top as described herein.

DESCRIPTION OF THE PRIOR ART

The prior art is replete with different types of mechanisms used for holding blotter paper or its backing surface, or both, to some type of mount. For example, in U.S. Pat. No. 522,432 to Rudge et al. blotter paper D is disclosed having a rocker-shaped back support spring B with ends as double curves and extensions c. The cross piece A or mount is held to the blotter and spring at the spring's curved ends. In the patent to Bacon (U.S. Pat. No. 582,164) a writing pad has a blotter T held in place by four corner straps C. The reference (U.S. Pat. No. 584,040) to Keeler discloses a box D' and blotter L mounted to it at its free ends N by glue or other means. In the U.S. Pat. No. 708,525 to Buskirk a blotter b is held at its corners by triangular corner clips or pockets 2. The Murray patent (U.S. Pat. No. 736,289) describes a plotting pad having a body or mount 1, a handle 10, and a clamping plate 8 which holds the ends of the blotting paper to the mount. Additional prior art such as U.S. Pat. No. 835,323 to Raupach disclose a blotting paper c on a curved plate a with turned up ends b wherein the upper flexible metal plate J holds the paper and plate a between the ends b and the lower bridge piece d. Still other art, such as U.S. Pat. 1,009,785 to Peterson, describes a blotting pad having a top plate 1, a bottom plate 2 with rolled ends and a blotter 9. The two interfacing ends of the two plates hold the blotter in place against the lower plate 2. Another reference, U.S. Pat. No. 1,182,919 to Magosy, describes a blotter 3 with a rocker blotter 2. The turned in flanges 4 of the mount's top piece 1 hold the blotter against the rocker 2. While in U.S. Pat. No. 1,405,558 to Schwartz there is described an internal roll of blotting paper 19 in semi-elliptical box 1 which exits through slots 31 and rests against a backing. Further references like U.S. Pat. No. 1,460,507 to Schwartz have mounts for the blotter rollers with a pair of end frames 2 and a blotter plate 1 for the blotter roll 13. In U.S. Pat. No. 1,785,229 to Schuelke a combined desk blotter and box 10 with turned down end lips 12 with short flanges 19 on top 16 is disclosed. The blotter 13 fits between the lips 12 and flanges 19 and is held in place. Still another reference, U.S. Pat. No. 2,272,955 to Spitalnik, discloses a blotter having a rocker member 18 with end slots 22 to hold the blotting paper 24 when the upper frame 10 clamps its ends. And furthermore, U.S. Pat. No. 3,161,177 to Gach discloses a blotter holder wherein the ends of blotter 25 are held in place by the end blotter retainers 23 on the curved part of the holder. None of these references or the prior art describe a blotter mount wherein the blotter mount has facing opposed end lips which act as the sole retainer for the ends of a flexible blotter paper backing and its blotter paper as more further set forth in this specification.

SUMMARY OF THE INVENTION

This invention relates to a blotter having a flexible blotter paper backing which is retained in slanted lips located in opposite sides of a blotter mount. The backing may be interchanged with other flexible backings that fit into the mount's lips making it a universal mounting plate which plate is seated in the back of a blotter top.

It is the primary object of the present invention to provide for an improved interrelated flexible blotter paper backing and a mounting plate apparatus which can be recessed or attached to blotter tops made of various materials such as wood, acrylic, etc.

Another object is to provide for such an apparatus wherein the backing is held in place to the mounting plate solely by opposite slanted lips in the plate.

These and other objects and advantages of the present invention will become apparent to readers from a consideration of the ensuing description and the accompanying drawings.

DESCRIPTION OF THE PREFERRED EMBODIMENT

Figure 1:
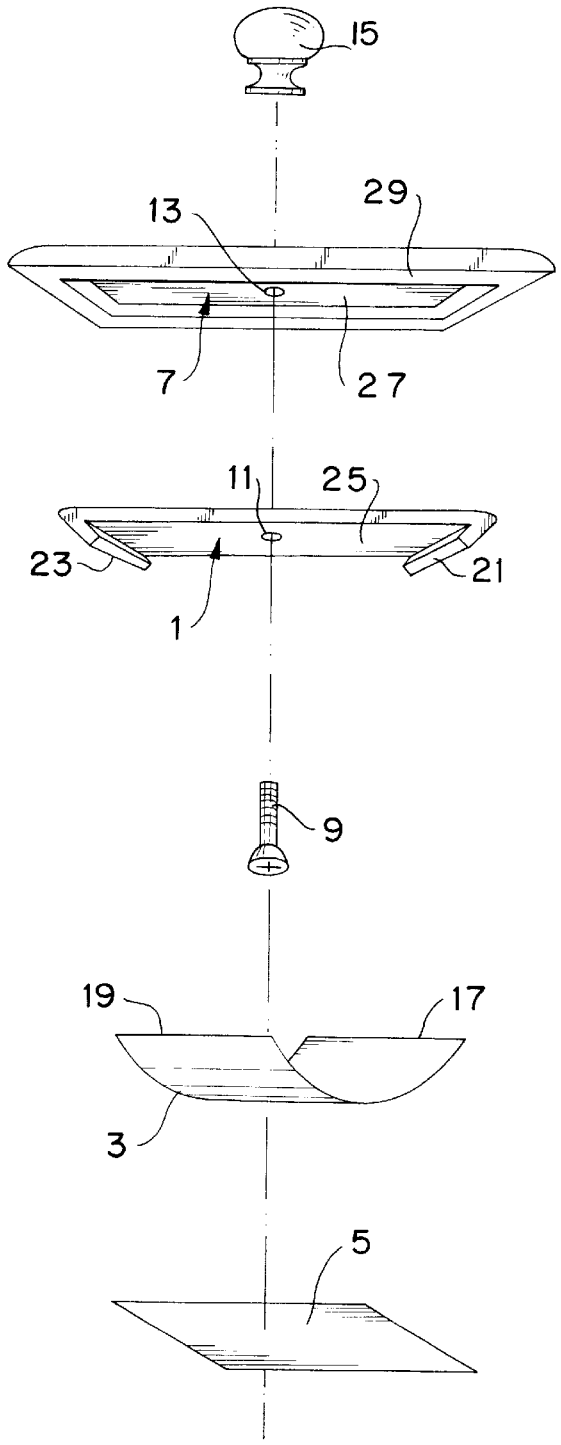
FIG. 1 is an exploded side perspective view of the invention's preferred embodiment .

FIG. 1 is an exploded side perspective view of the invention's preferred embodiment. The interrelated apparatus components consist of the mounting plate 1, the flexible blotter paper backing 3, the blotter paper 5, the recessed mount for the mounting plate 7, the threaded screw 9 which fits through holes 11 and 13 in the mounting plate 1 and the recessed backside of the blotter top 7, respectively, and the center holed internally threaded end knob 15 that engages the end of screw 9 to hold the members 1 and 7 together.

Figure 2:
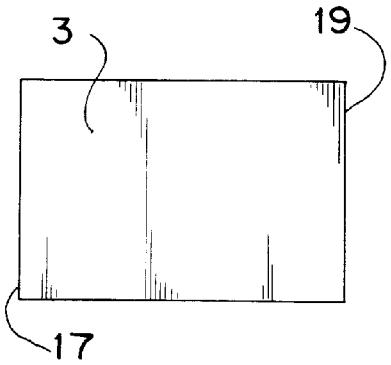
FIG. 2 is a top view of the flexible backing used in the FIG. 1 embodiment.
Figure 3:
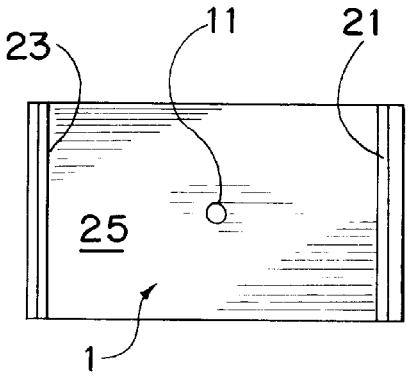
FIG. 3 is a bottom view of the mounting plate used in the FIG. 1 embodiment.

FIG. 2 is a top view of the flexible backing 3 used in the FIG. 1 embodiment. This backing may be made of a curved rectangular shaped rocker-shaped pliable metal material whose two opposite ends 17 and 19 may be bent to fit into the inwardly slanted end lips 21 and 23 located extending from the flat surface of plate 1. As shown in the FIG. 3 bottom view of the universal mounting plate 1, these plate lips extend completely across the two opposite sides of the plate's edges and form an angle of 45 degrees or less with the flat plate surface 25. By bending the flexible and pliable ends of backing member 3 by hand, its ends may fit into the lip's two formed recesses to hold the backing 3 to the plate 1. Normally the blotting paper 5 is about the same size and shape as the backing member 3 and bears directly against the back member's two end lips while the remaining of the blotting paper bears on and lies flush against with the backing member 3. Thus, the resilient backing member 3 holds the blotting paper to it by bearing against the paper on most of its facing surface area while the ends of the blotting paper and backing members are both mounted at their ends in the mounting plate's slanted opposite end lips 21 and 23.

Figure 4:
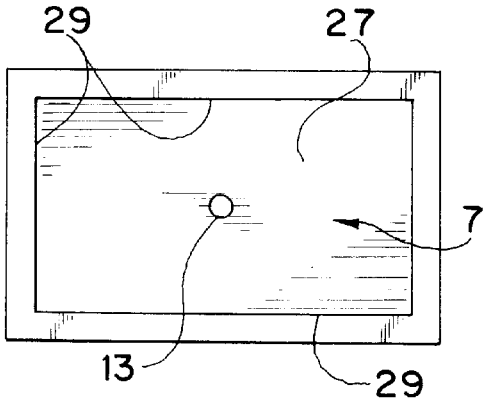
FIG. 4 is a bottom view of the blotter top in which the mounting plate is recessed in the FIG. 1 embodiment.

FIG. 4 is a bottom view of the blotter top 7 whose facing recessed area seats, in a recessed manner, the mounting plate 1 of the FIG. 1 embodiment. The top's recessed area plate portion 27 is rectangular in shape and sized to receive the generally rectangular shape of the plate 1 in a tight manner. The four framed raised edges 29 around the recess portion 27 act as side supports for the inserted recessed mounting plate 1.

Figure 5:
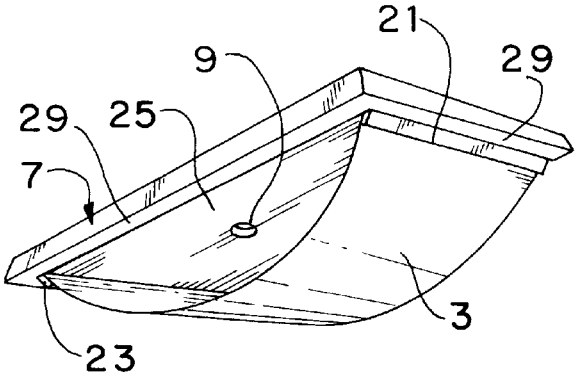
FIG. 5 is an assembled side perspective view of the FIG. 1 preferred embodiment without its blotting paper.

FIG. 5 is an assembled side perspective view of the FIG. 1 preferred embodiment without its normally exposed blotting paper. The flexible metallic backing 3 has two of its opposite edges inserted into the two opposite recesses of the slanted raised end lips 21 and 23. The head of threaded screw 9 is visible and its lower end portion is threadly received by the hand held knob 15 (not shown) located above the plate 7. When blotting paper of approximately the same size and shape as backing 3 is inserted over the backing with its edges in the same lips as the backing, it is held in place against the bent flexible backing. To change the blotting paper or to insert a new backing into the lips, the backing 3 (and any mounted blotter paper) is simply bent to a more severe bent and lifted from its retaining end lips on plate 1. This simple interchangeability of blotter backings and blotter paper provides a rapid versatility lacking in many prior art blotter assemblies.

Figure 6:
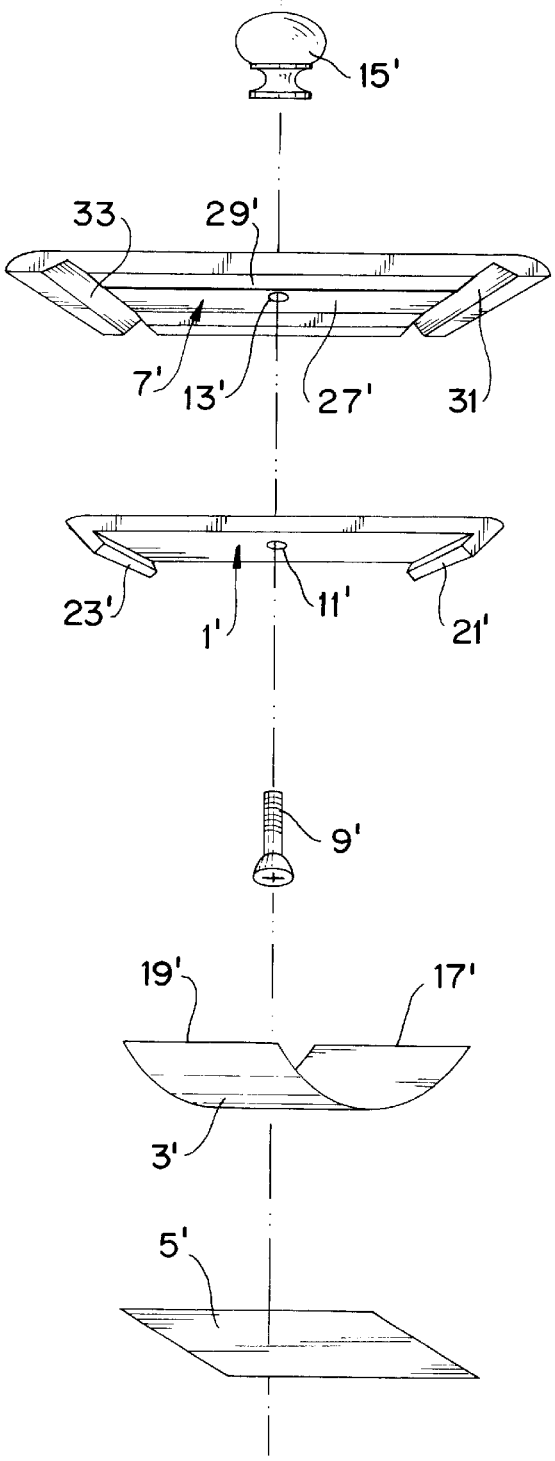
FIG. 6 is an exploded side perspective view of an alternate embodiment for the invention.

FIG. 6 is an exploded side perspective view of an alternate embodiment for the invention. The same component numbers used in the FIG. 1 embodiment are used in this alternate embodiment with a prime added. The essential only difference between the two embodiments relates to plate 7' and how the flexible backing 3' is inserted into it. In the first preferred embodiment the backing 3 was placed into the recessed area 27 by bending into the slanted lips 21 and 23. In the alternate second embodiment the backing 3' may be bent and inserted through the routed slots 31 and 33 which extend across the width of the recessed area 27'. The side notches act to retain the two facing planar members 1' and 7' together.

Figure 7:
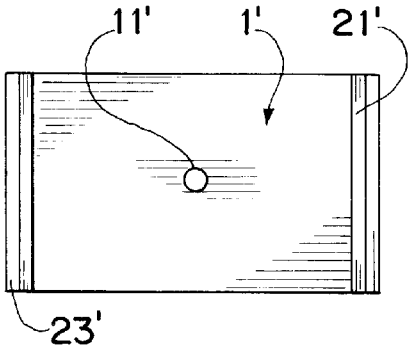
FIG. 7 is a bottom view of the the mounting plate 1' used in the FIG. 6 alternate embodiment.

FIG. 7 is a bottom view of the plate 1' used in the FIG. 6 alternate embodiment. This plate is essentially the same as the plate 1 used in the first or preferred embodiment.

Figure 8:
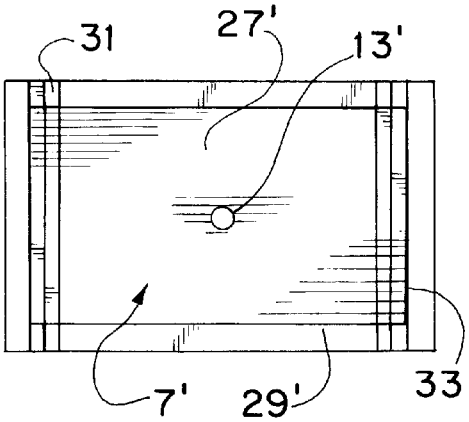
FIG. 8 is a bottom view of the blotter top whose backside has the mounting plated used in the FIG. 6 alternate embodiment is mounted in its recesses.

FIG. 8 is a bottom view of the blotter top 7' used in the FIG. 6 alternate embodiment. In this view the V-shaped notches 31 and 33 are shown extending completely across the end width of the plate 7'. Each such notch extends through two sides of the raised edges 29' to permit the bent plate's 3' easy insertion from and retention with respect to the mounting plate 1'. As in the first embodiment, the internal threads of retaining knob 15' engage the inserted externally threaded end of screw 9' to assure a secure retention between the two members 1' and 7'. When the internal threads of knob 15' tighten the threads on the screw 9' to it, the edges of plate 1' will be hidden and provide a smooth flat appearance when viewed from the side. The assembled second embodiment would closely resemble the assembled FIG. 5 embodiment except for the slightly visible two V-shaped side end notches.

It should be clear that the mounting plates 1 and 1' could also be formed as unitary units with their respective recessed blotter tops 7 and 7', respectively, if such is less expensive or easier to do in the manufacturing process. They could also be bonded together to form a unitary by using any appropriate bonding material such as glue. Further, the mounting plates 1 and 1' may be made of any commonly used material such as acrylic, metal, etc. desired. The blotter tops 7 and 7' may also be made of commonly used material such as wood or acrylic. Other types of fastening mechanisms may also be used in place of the threaded screw and knob to hold the two members together such as bolts with end nuts, bonding material between the plates, etc.

I claim:

1. A blotter apparatus comprising:

a rigid blotter mount having a substantially flat surface with two spaced slanted lips extending upwardly from the mount's flat surface;

a flexible blotter backing having two opposite ends adapted to be held to the blotter mount by inserting each of the ends into the two spaced slanted lips such that said backing is held thereto only by its engagement with the lips; and a sheet of blotter paper having two opposite ends mounted over said blotter backing with the paper's opposite ends interposed and engaged between said blotter backing ends and the blotter mount's slanted lips whereby said paper is held to the blotter backing by this engagement.

2. The apparatus of claim 1 wherein said blotter mount's slanted lips are on opposite sides of the mount and slant upwardly and inwardly towards each other at an angle of no more than 45 degrees from the mount's flat surface.

3. The apparatus of claim 2 wherein said blotter backing is shaped and sized to approximately resemble the shape and size of the blotting paper.

4. The apparatus of claim 3 also including:

a blotter mounting plate member adapted to receive the blotter mount and having a hole through its surface which plate member hole aligns with a hole through the blotter mount; and fastening means insertable through said aligned holes in the blotter plate member and blotter mount to hold them together.

5. The apparatus of claim 4 wherein said fastening means includes a threaded member and an internally threaded knob on one side of the blotter plate member that can engage the threads on the threaded member.

6. The apparatus of claim 5 wherein said blotter mounting plate member has a recessed surface area adapted to receive the blotter mount therein.

7. The apparatus of claim 1 wherein said flexible blotter backing is made of a pliable metallic material whose lip engaging ends are bent to accommodate the blotter mounting's slanted lips.

8. The apparatus of claim 4 wherein said blotter mounting plate has a recessed area with raised edges and V-shaped notches near two of the plate's raised ends, said notches extending completely across the width of the plate to permit the easy insertion of the flexible backing from a side of the mounting plate into the blotter mount's slanted lips.

* * * * *